United States Patent [19]

Blackwell

[11] 4,399,636

[45] Aug. 23, 1983

[54] THERMAL INSULATED DOORSILL APPARATUS WITH INSULATING SPACER FASTENER

[75] Inventor: Donald W. Blackwell, Bend, Oreg.

[73] Assignee: Pozzi Window Company, Inc., Bend, Oreg.

[21] Appl. No.: 313,452

[22] Filed: Oct. 21, 1981

[51] Int. Cl.[3] ..... E06B 7/16

[52] U.S. Cl. ..... 49/469; 49/DIG. 1; 49/425; 160/91

[58] Field of Search ..... 49/467, 468, 469, 470, 49/425, DIG. 1; 160/90, 91

[56] References Cited

U.S. PATENT DOCUMENTS

| | | | |
|---|---|---|---|
| 2,856,651 | 10/1958 | Hobbs | 20/64 |
| 3,061,896 | 11/1962 | Wahlfeld | 20/64 |
| 3,118,192 | 1/1964 | West | 49/469 |
| 3,346,994 | 10/1967 | Kesler | 49/470 |
| 3,382,617 | 5/1968 | St. Aubin | 49/468 |
| 3,436,884 | 4/1969 | Bell et al. | 49/425 X |
| 3,517,472 | 6/1970 | Toth | 52/403 |
| 3,526,996 | 9/1970 | Fraleigh et al. | 49/501 |
| 3,885,351 | 5/1975 | Imperial et al. | 49/501 |
| 3,967,412 | 7/1976 | Governale | 49/468 |
| 3,990,187 | 11/1976 | Brown et al. | 49/467 |
| 4,064,653 | 12/1977 | Randall et al. | 49/DIG. 1 X |
| 4,224,766 | 9/1980 | Procton | 49/468 |

*Primary Examiner*—Philip C. Kannan

*Attorney, Agent, or Firm*—Klarquist, Sparkman, Campbell, Leigh, Whinston & Dellett

[57] ABSTRACT

A doorsill apparatus for a sliding glass patio door or other exterior door is described including a heat insulating spacer fastener for securing inner and outer sill members of metal against relative movement. The heat insulating spacer fastener is preferably a synthetic plastic clip member. The plastic clip member is of a general W-shape and fastens the inner and outer doorsill members together by clipping onto first and second projections extending from such sill members. In addition, a moisture barrier member of synthetic plastic material is provided over the joint formed by the insulating spacer clip and extends along the upper surfaces of the sill members to prevent moisture from condensing and forming frost on the inside of the glass patio door.

14 Claims, 4 Drawing Figures

THERMAL INSULATED DOORSILL APPARATUS WITH INSULATING SPACER FASTENER

BACKGROUND OF INVENTION

The subject matter of the present invention relates generally to heat insulated doorsill apparatus and in particular to such doorsill apparatus including an insulating spacer fastener which fastens inner and outer sill members of metal together against relative movement. A preferred embodiment of the invention includes an insulating spacer clip of synthetic plastic material which clips onto projections extending from the sill members to fasten such sill members together.

The present invention is especially useful in the construction of sliding glass patio doors and other exterior doors which include an outer sill member that is exposed to the exterior weather and atmospheric temperatures and an inner sill member that is at room temperature in the interior of the house or other building. The inner and outer sill members are thermally insulated from each other by the insulating spacer clip of the present invention, and are fastened together against relative movement by such clip for simplier and less expensive manufacturing of a door assembly employing such doorsill apparatus.

It has been proposed in U.S. Pat. No. 3,382,617 of St. Aubin granted May 14, 1968 to provide an insulated doorsill apparatus in which inner and outer sill members of metal are supported in insulating relationship by wood core members. A plastic bridging section which extends over the gap between the inner and outer sill members is employed to prevent moisture condensation and to provide an additional heat insulation. However, the plastic bridging section is not a clip member and does not fasten the inner and outer sill members together against relative movement. Instead, the bridge section is provided with an elongated slot which enables lateral movement of the outer sill member to accommodate doors of different size. The bridging section engages weather stripping on the bottom of the door to prevent cold air from passing from the exterior to the interior of the building.

U.S. Pat. No. 4,224,766 of Procton granted Sept. 30, 1980 shows an insulated threshold or doorsill apparatus having a plastic bridging member which is a thermal barrier and also forms a seal with the bottom of the door and is adjustable in height and width to accommodate different size doors. U.S. Pat. No. 3,061,896 of Wahlfeld granted Nov. 6, 1962 shows a similar teaching. A plastic joint member with keyed ends is provided in the Procton patent for holding inner and outer sill members together after they have been extruded as an integral member and then cut apart into two separate members. However, the plastic joint is not a clip member and does not clip onto projections extending from the inner and outer members. Instead, its keyed ends slide longitudinally within U-shaped channels provided in the inner and outer sill members which makes it difficult to install the joint member due to high friction. Also, the extruded channels increase the cost of the threshold. U.S. Pat. No. 3,346,994 of Kesler granted Oct. 17, 1967 shows a similar teaching for securing three metal members together. It is also known to provide similar thermal barrier members of plastic in window frames, such members being provided with keyed ends which are inserted longitudinally in keyway slots in the two metal members to be joined.

In the above patents, a wood core is employed to insulate and fasten the inner and outer sill members from each other which is not necessary in the insulated sill apparatus of the present invention. In addition, the plastic bridging section which also acts as a door seal is subject to wear due to abrasion by the bottom of the door, and the feet of people crossing the threshold. This is not a problem with the insulating spacer clip of the present invention because it is spaced below the upper surface of the sill members and is located at the bottom of the sliding door channel so that it is not subject to abrasive wear by either the door or by the feet of people crossing the doorsill.

The insulating spacer clip of the present invention enables the manufacture of insulated doorsill apparatus less expensively and more conveniently than that of the prior art. For example, it is presently the practice to form a thermal barrier, such as the plastic joint member 23 of the Procton patent by pouring liquid plastic, such as epoxy resin, into the channel space provided by the portions 21 and 22 of the sill member 12 which are extruded as an integral member before the slot 56 is milled out to separate such members. Of course, this is very time consuming and so expensive that a large number of doorsill apparatus must be manufactured at the same time to make it practical.

SUMMARY OF INVENTION

One object of the present invention is to provide an improved insulated doorsill apparatus which includes a thermal insulating spacer fastener for fastening inner and outer sill members of metal together against relative movement.

Another object is to provide such a doorsill apparatus which is inexpensive to manufacture and employs a clip member of synthetic plastic material as such insulating spacer fastener to fasten the inner and outer sill members together.

A further object of the invention is to provide such a doorsill apparatus in which the insulating spacer clip is positioned remote from the door so that it is not subject to wear.

An additional object of the invention is to provide such a doorsill apparatus including a moisture barrier member which extends over the upper surfaces of the insulating spacer fastener and the inner and outer sill members to prevent moisture from condensing on the interior of the door.

Still another object of the invention is to provide such a doorsill apparatus which is easier to assembly and cheaper to manufacture by employing a thermal insulation spacer clip which fastens over projections extending from such sill members.

A still further object of the invention is to provide a sliding glass patio door assembly including an insulated doorsill apparatus having inner and outer doorsill members of metal which are fastened together against relative movement by a thermal insulating spacer clip to reduce the cost of manufacture.

DESCRIPTION OF DRAWINGS

Other objects and advantages of the present invention will be apparent from the following detailed description of a preferred embodiment thereof and from the attached drawings of which.

DESCRIPTION OF PREFERRED EMBODIMENT

Figure 1:
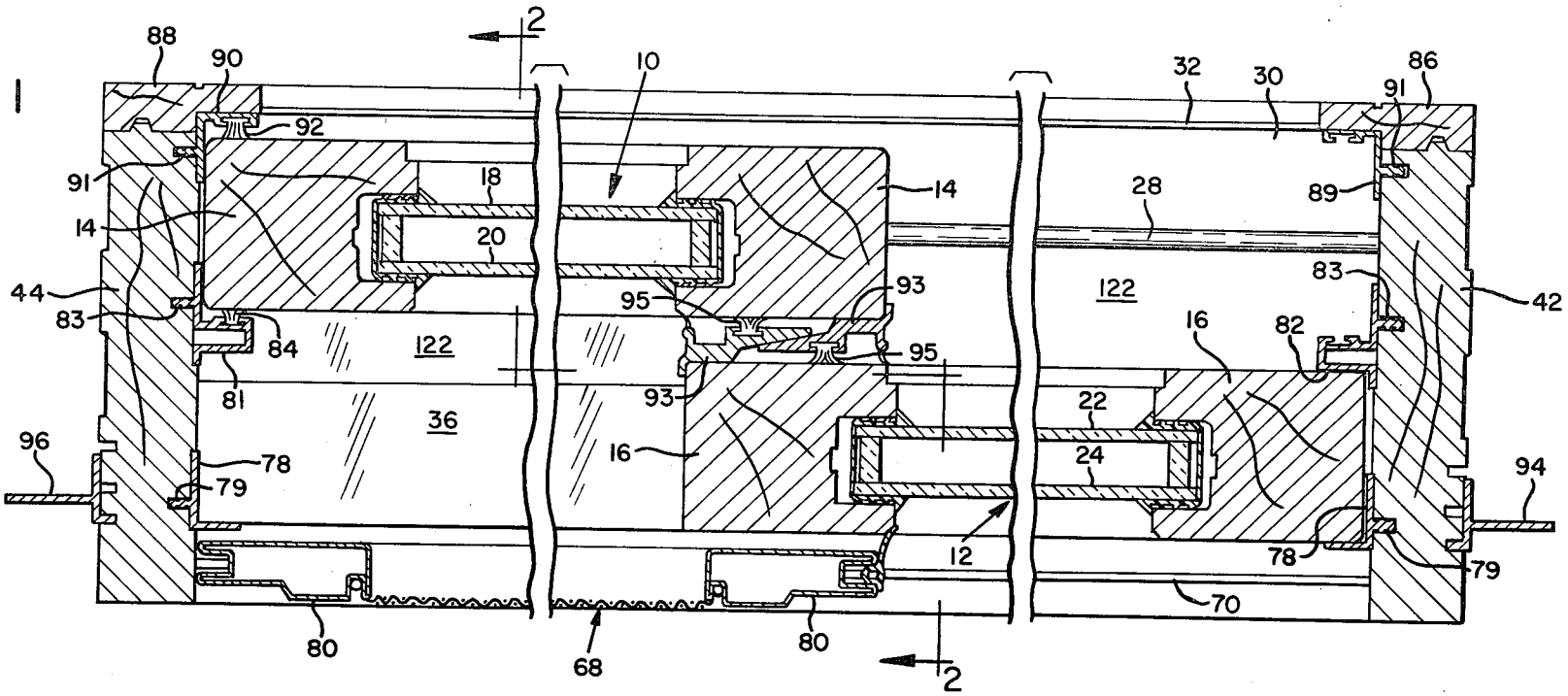
FIG. 1 is a foreshortened plan view of a sliding glass patio door assembly including the insulated doorsill apparatus of the present invention.
Figure 2:
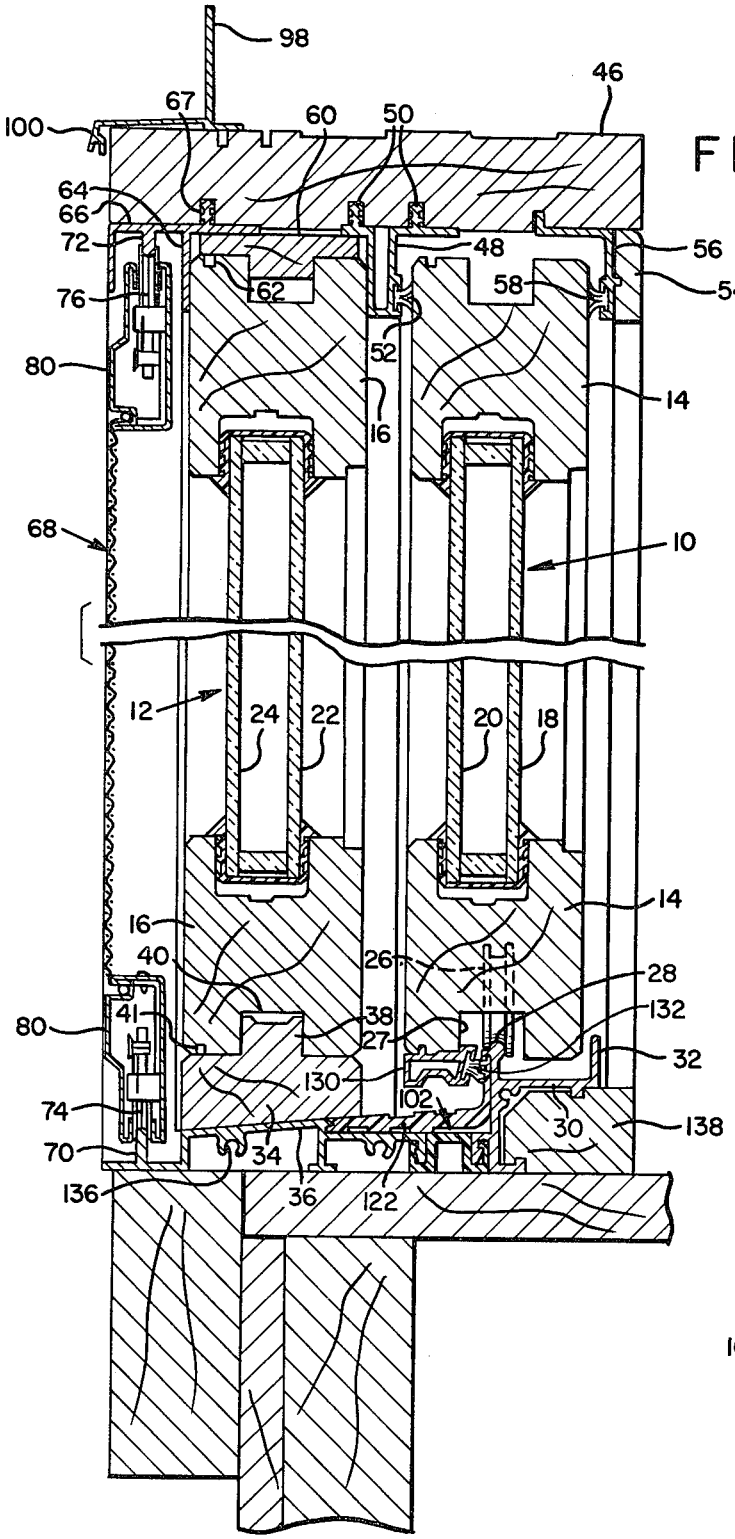
FIG. 2 is a foreshortened vertical section view taken along the line 2—2 of FIG. 1.

As shown in FIGS. 1 and 2, the thermal insulated doorsill apparatus of the present invention is especially useful when employed as part of a sliding patio door assembly including a sliding glass door 10 and a fixed glass partition 12. The door 10 and partition 12 are each provided with a frame 14 and 16, respectively, which may be made of wood and a pair of glass plates 18, 20 and 22, 24, respectively, mounted in spaced sealed relationship to provide a double glazed glass patio door and partition of conventional construction.

The sliding door 10 is mounted on a plurality of rollers 26 which are supported for vertical adjustment within a slot 27 in the bottom of the lower door frame member 14. The rollers 26 engage a track rail 28 formed integral with an inner doorsill member 30 of metal such as extruded aluminum. The inner sill member 30 includes a track flange 32 which extends upwardly in the same direction as the track rail 28 and is spaced therefrom to form a U-shaped channel track which receives the bottom edge of the inner half of the lower door frame member 14 to the right of slot 27 in FIG. 2.

The fixed glass partition 12 is mounted on a bottom rail filler 34 of wood which is supported on an outer doorsill member 36 of metal such as extruded aluminum. The filler member 34 includes a top projection 38 which extends into a notch 40 in the bottom of the lower wood frame member 16, such notch normally accommodating the support rollers 26 when such door is employed as a sliding door. Filler member 34 is keyed to frame member 16 by a metal pin 41 to prevent relative movement.

The door assembly includes a pair of side jamb members 42 and 44 on opposite sides of the door assembly and a head jamb member 46 on top of such assembly. These jamb members surround the door 10 and partition 12 and may be all made of wood. Their exposed surfaces may be covered with a thin layer of vinyl as may be the surfaces of the door frames 14 and 16. A head spacer member 48 of polyvinyl chloride or other suitable plastic is mounted in notches in the head jamb 46 by means of barbed projections 50 provided on the top surface of such spacer member to support the head spacer member between the top frames 14 and 16 of the sliding door 10 and the partition 12. Weather stripping 52 is mounted within a horizontal slot in the inside surface of the head spacer 48 so that such weather stripping engages the surface of the door frame 14 to form a seal therewith. A head stop member 54 is secured to the bottom of the head jamb 46 and extends horizontally across the width of the door assembly at the top inner edge thereof to hold the door frame 14 between such head stop and the head spacer 48. A weather strip support member 56 of polyvinyl chloride or other plastic is secured to the outer surface of the head stop 54 and to the lower surface of the head jamb 46 to position weather stripping 58 mounted in a horizontal slot provided in support 56 in contact with the inner surface of the door frame 14 to form a seal therewith, as shown in FIG. 2.

A top sash frame filler 60 of wood is secured to the upper surface of the top frame member 16 and is keyed thereto by a pin 62 to prevent sliding movement of the fixed door partition 12. A flange 64 extending downward from a top track member 66 of aluminum which provides a channel track for a sliding screen door is secured by barbed projections 67 in notches in the bottom of the head jamb 46. Flange 64 cooperates with the spacer member 48 to hold the frame member 16 therebetween to prevent lateral movement of the fixed partition 12.

The sliding screen door 68 is mounted on a bottom track rail 70 projecting upward from the outer sill member 36 and on a top track rail 72 projecting from the top track member 66 by means of track rollers 74 and 76, respectively, which are adjustably mounted in the metal frame 80 on such screen door at the top and bottom, respectively. The screen door frame 80 is made of extruded aluminum and all of the aluminum members are preferably anodized. Also, it should be noted that the top track member 66 is welded or fastened by screws to a pair of vertical frame members 78 which are attached by barbed projections 79 to the side jamb members 42 and 44. Similarly, two vertical spacer members 81 and 82 formed of polyvinyl chloride or other plastic are attached by barbs 83 to the inner surface of the side jambs 42 and 44 in position to space the sliding door 10 from the fixed door 12 in a similar manner to the horizontal extending head spacer 48.

Thus, side spacer 81 is provided with a weather strip 84 in a vertical slot which engages the outer surface of the left side frame 14 to form a seal therewith as shown in FIG. 1. In addition, inside stop members 86 and 88 made of wood are provided along the inside vertical surface of the side jamb members 42 and 44, respectively, and project inward from the edge of the jamb members into the door opening approximately ¾ of an inch. A pair of weather support strip members 89 and 90 of polyvinyl chloride or other plastic are supported by barbs 91 vertically on the inner surface of stop members 86 and 88 and the inner surface of the side jamb members 42 and 44. A weather strip 92 is mounted within a vertical slot in the surface of the support member 90 in position to engage the inner surface of the door frame 14 when the sliding door 10 is in the closed position shown in FIG. 1. A pair of weather strip support members 93 are attached to the inside edge of left side frame member 16 and outside edge of right side frame member 14 to support weather strips 95 in vertical slots for sealing the right side frame 14. The support members 93 are provided with a tapered shape so that they overlap in the closed position of door 10.

A pair of side mounting members 94 and 96 of aluminum are secured to the outside of the side jamb members 42 and 44, respectively, and are each provided with an outwardly extending nailer flange. A top mounting member 98 is secured to the upper surface of the head jamb 46 and is also provided with such an outwardly extending nailer flange to mount the door assembly in the door opening of a house or other building. It should be noted that the top mounting member 98 is provided with a downward sloping drip rail portion 100 which extends outwardly beyond the screen of the screen door 68 so that rain water dripping down from the drip rail 100 does not fall on the screen door except under adverse wind conditions.

Figure 3:
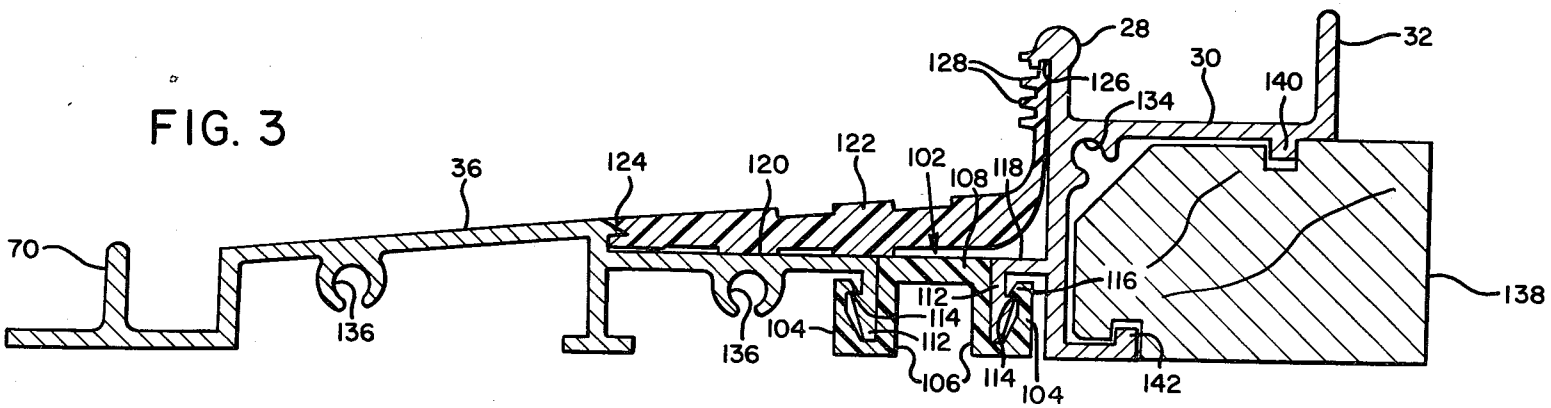
FIG. 3 is an enlarged view of a portion of FIG. 2 showing the doorsill apparatus including the thermal insulating spacer clip and the moisture barrier member.

As shown in FIG. 3 the inner sill member 30 and the outer sill member 36 are attached together and held against relative movement by a thermal insulating spacer clip 102 of polyvinyl chloride plastic or other suitable plastic insulating material. The spacer clip 102 is of a general W-shaped cross-section including outer leg portions 104 which are connected at their bottom ends to a pair of spaced inner leg portions 106 whose top ends are joined to an intermediate web or bridge portion 108. The outer legs 104 are spaced from the inner legs 106 of the clip 102 by slots 110 into which are inserted projections 112 extending downward from the bottoms of sill members 30 and 36. Thus, the clip 102 fastens the inner sill members together by clipping over projections 112 on such sill members.

Figure 3A:
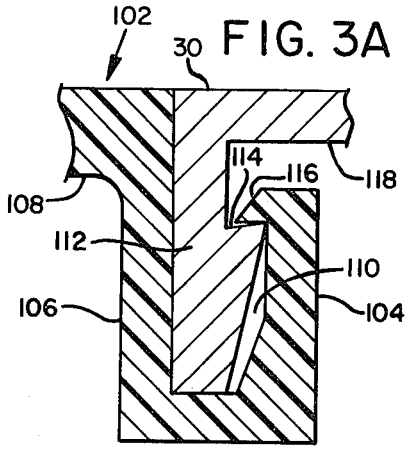
FIG. 3A is an enlarged view of a portion of FIG. 3.

As shown in FIG. 3A, the projections 112 are each provided with a tapered lower portion whose width increases from a minimum of 0.062 inch at its bottom end to a maximum of about 0.095 inch at a shoulder 114. Each outer leg 104 has a width of 0.062 inch which is provided with an inwardly extending lip portion 116 at its top end which increases in width to 0.093 inch, such lip engaging the shoulder 114 of projection 112 to hold the clip 102 on such projections.

The top surface of bridge portion 108 of the spacer clip 102 is substantially coplaner with the top surfaces 118 and 120 of the adjoining portions of the inner and outer sill members 30 and 36 from which projections extend and fills in the joint between such sill members. However, to prevent moisture laden exterior air from leaking through such joint and causing moisture condensation or frost on the inner surface of glass 18 on the sliding door, a moisture barrier member 122 of polyvinyl chloride or other suitable plastic is mounted over the surfaces 118 and 120 of the sill members and the clip 102. The moisture barrier 122 is held by a notch in its left end into which is inserted a sharp lip 124 projecting from the outer sill member. The right end of such moisture barrier bends upward and extends into a notch 126 formed in the bottom of the track rail 28. A vertical extending portion of the moisture barrier member is provided with a plurality of spaced horizontal ribs 128. A weather strip support member 130 of polyvinyl chloride plastic is attached to the left half of the bottom frame member 14 and provided with a horizontal slot in which a weather strip 132 is mounted so that such weather strip engages the ribs 128 to form a seal therewith. Screw slots 134 and 136 are provided in the bottom of the inner and outer sill members 30 and 36 for attaching such sill members to the side jambs 42 and 44. Also, a sill filler member 138 of wood is held beneath the track channels 28, 32 by flanges 140 and 142 projecting from the bottom of the inner sill member into notches in such filler.

It will be obvious to those having ordinary skill in the art that many changes may be made in the preferred embodiment of the invention. Therefore, the scope of the present invention should only be determined by the following claims.

I claim:

1. Doorsill apparatus for installation beneath an exterior door, comprising:

an outer doorsill member of metal extending outside of said door and having a first projection thereon;

an inner doorsill member of metal extending inside of said door having a second projection thereon;

spacer clip means of synthetic plastic material for fastening said outer sill member and said inner sill member together against relative movement by clipping onto said first and second projections, said clip means spacing said outer sill member from said inner sill member for heat insulation thereof and including a bridge portion extending across the space between said inner and outer sill members providing a substantially continuous upper surface from said inner sill member to said outer sill member.

2. Apparatus in accordance with claim 1 in which the first and second projections project downward into first and second channel portions of a spacer clip member and the bridge portion extends between said channel portions to provide said continuous upper surface as a substantially flat surface.

3. Apparatus in accordance with claim 2 in which the projections are each provided with a shoulder intermediate the opposite ends of the projection and the channel portions of the clip member are each provided with an inner flange at the entrance of the channel which engages said shoulder to hold said projections in said channel portions.

4. Apparatus in accordance with claim 2 in which said bridge portion extends across the space between said inner and outer sill members to provide a continuous upper surface from the base end of the first projection to the base end of the second projection.

5. Apparatus in accordance with claim 4 which also includes a moisture barrier member of synthetic plastic material extending over said clip member along the continuous upper surface between said outer sill member and said inner sill member.

6. Apparatus in accordance with claim 1 in which the inner sill member is provided with a track means for the bottom of a sliding glass door.

7. Apparatus in accordance with claim 6 in which the track means includes a track rail means for engagement with rollers on said sliding door, said track rail means projecting from the top of said inner sill member so that the bottom of said sliding door is spaced above said clip means.

8. A sliding door assembly, comprising:

at least one sliding glass door mounted within a door frame for horizontal sliding movement;

an inner doorsill member of metal attached to said frame and extending beneath the sliding door to the inside of said doors;

an outer doorsill member of metal extending beneath the sliding door to the outside of said door; and spacer means of non-metallic heat insulation material for fastening said outer sill member to said inner sill member against relative movement and spacing said inner sill member from said outer sill member for heat insulation thereof, said spacer means including a clip member of a generally W-shape cross-section including two pairs of legs of substantially equal length with each pair of legs separated by a channel into which extends one of the inner and outer sill members.

9. An assembly in accordance with claim 8 in which the spacer means is a clip member of synthetic plastic material which is fastened to the inner and outer sill members by clipping onto first and second projections extending from said inner and outer sill members.

10. An assembly in accordance with claim 9 in which said first and second projections project into first and second channel positions of said clip member which are joined by an intermediate bridge portion extending between said channel portions.

11. An assembly in accordance with claim 8 in which the outer sill member is a threshold member which extends under a fixed glass door panel to the exterior side thereof.

12. An assembly in accordance with claim 8 in which the inner sill member is provided with a track means for guiding the movement of the sliding glass door and includes a track rail portion which engages rollers on the bottom of said sliding door so that said bottom is spaced above said spacer means.

13. An assembly in accordance with claim 8 in which a moisture barrier member of synthetic plastic material extends over the spacer means along the upper surfaces of said inner and outer sill members.

14. An assembly in accordance with claim 13 in which the moisture barrier member includes a vertical end portion having a plurality of vertically spaced horizontal projections which are engaged by weather strip sealing means provided on the bottom of the sliding door.

* * * * *